United States Patent [19]

Laviguer

[11] Patent Number: 4,467,959

[45] Date of Patent: Aug. 28, 1984

[54] HEAT EXCHANGER AND VAPORIZER FOR A STOVE FLUE

[75] Inventor: Charles F. Laviguer, McCall, Id.

[73] Assignee: Progressive Energy Systems, Inc., Minn.

[21] Appl. No.: 475,016

[22] Filed: Mar. 14, 1983

[51] Int. Cl.[3] ..... F24B 7/00

[52] U.S. Cl. ..... 237/55; 126/113; 165/DIG. 2; 122/20 B

[58] Field of Search ..... 237/55, 50, 51; 165/DIG. 2; 126/101, 113

[56] References Cited

U.S. PATENT DOCUMENTS

Re. 19,546 4/1935 Toepfer ..... 126/113 X 4,313,562 2/1982 White ..... 237/55

*Primary Examiner*—Albert J. Makay

*Assistant Examiner*—Henry Bennett

*Attorney, Agent, or Firm*—Paul F. Horton

[57] ABSTRACT

A heat exchanger and vaporizer adapted for mounting on an existing flue for utilizing heat which is otherwise lost and for providing moisture for space heating and conditioning. The heat exchanger and vaporizer includes a central stack for unimpeded transport of flue gases; a casing, with air inlet and outlet, enveloping the stack; a vaporizor contained within the casing for efficient heat transfer and for room conditioning; and a motor-fan unit for producing an airflow through the casing. The vaporizer is in the form of non-corrosive heat conductive helical tubing for maximizing heat transfer in a given volume, for maintenance free use and for convenience in assembly. The vaporizer is provided with a plurality of vapor vents on its upper surface and a pour spout located externally of the casing.

5 Claims, 5 Drawing Figures

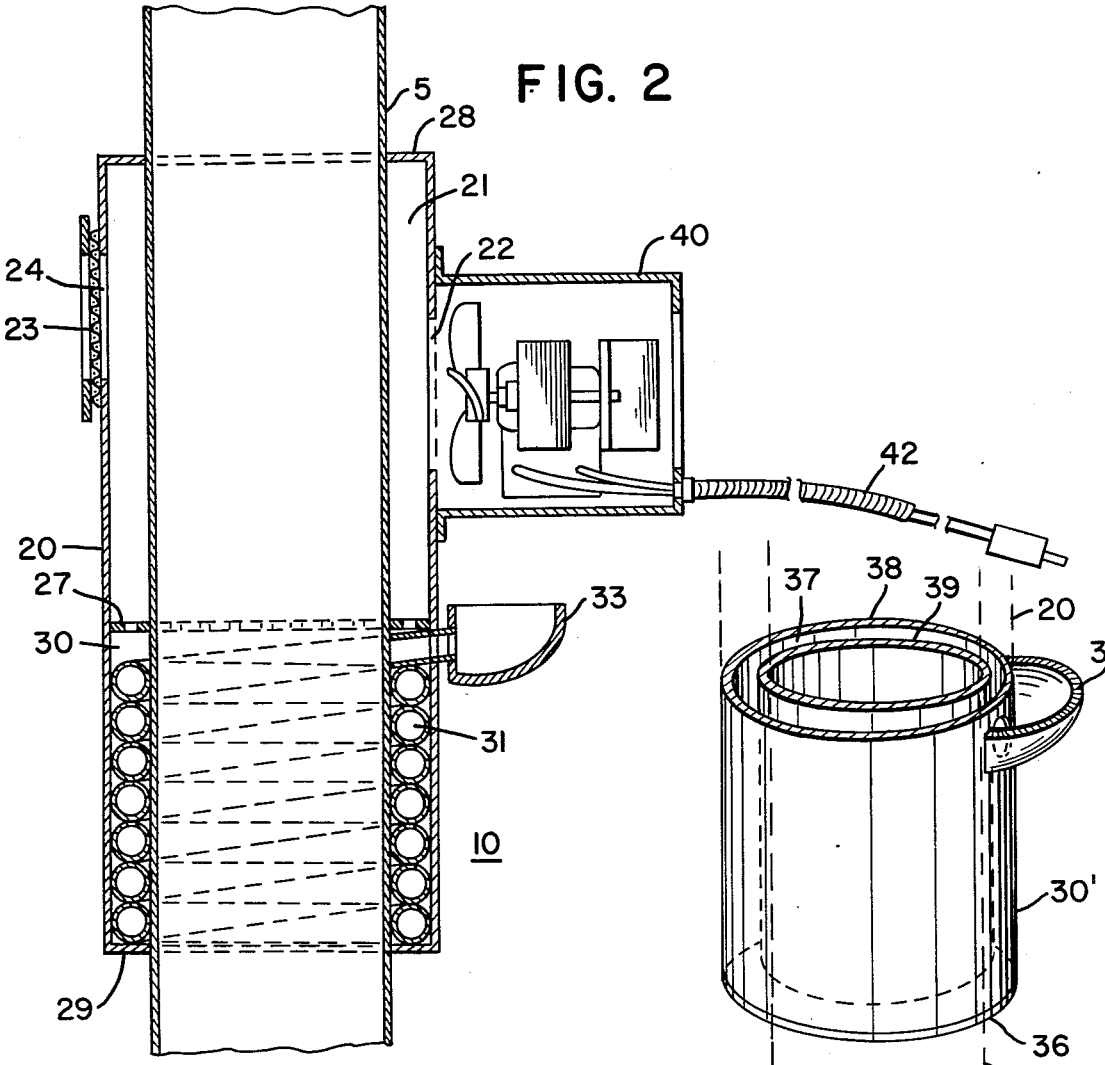
FIG. 2
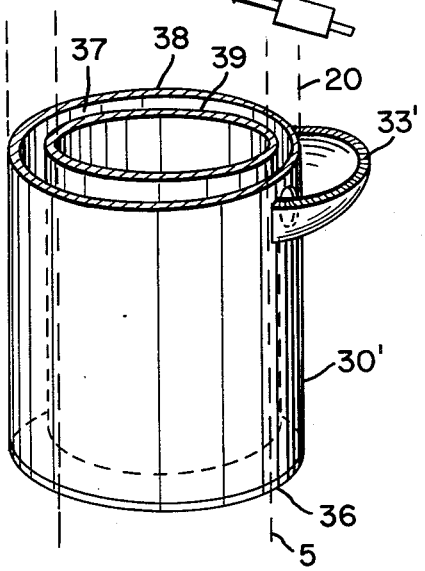
FIG. 5
FIG. 4
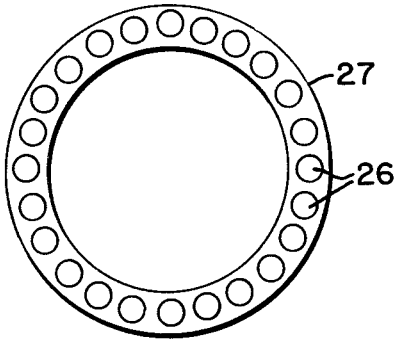
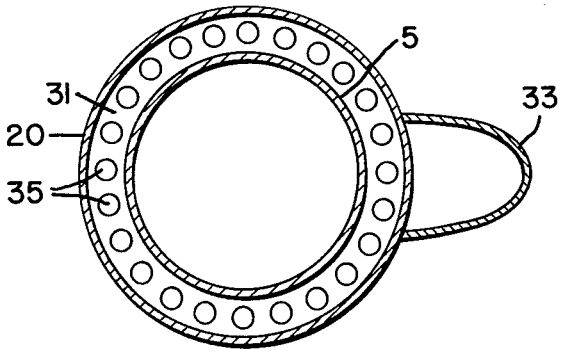
FIG. 3

HEAT EXCHANGER AND VAPORIZER FOR A STOVE FLUE

BACKGROUND OF THE INVENTION

1. Field of the Invention

This invention relates, in general, to heat exchangers and more particularly to heat exchangers which utilize vaporization of water for extracting heat from stove flues for space heating and humidification.

2. Description of the Prior Art

Stove flues are an essential part of free-standing stoves for the discharge of the flue gases and products of combustion. A free standing stove conventionally is connected to a chimney by means of a flue. In the discharge of flue gases into the atmosphere considerable amounts of heat are lost at large expense to the user.

Heat exchangers for extracting heat, otherwise lost, from flues are old in the art and are found in a variety of forms. The concentric pipe within pipe heat exchanger is perhaps the most simple form and has been used to great advantage in claiming the flue heat. To improve heat exchangers for economical reasons, new types of heat exchangers are constantly being developed. Much emphasis has been placed on cramming more heat transfer surface into less and less volume by the use of fin tubes, baffles, and the like as typified by U.S. Pat. No. 3,124,197 issued to R. S. Funk; U.S. Pat. No. 4,278,126 issued to F. M. Skrzypek; and U.S. Pat. No. 4,313,562 issued to R. H. White and by circuitous routing of either flue gases, room air, or both. Circuitous routing of flue gases interferes with the normal draw of the stove, often requires oversize flues, and may be dangerous in preventing escape of deadly gases. Circuitous routing of room air by fins, baffles, and the like often impede and restrict air flow causing whistling sounds, undersirable vibration of fin members, and clanking and rumbling where fins have worked loose. An alternative in preventing whistling or vibrations is to construct units which are ungainly large.

An additional problem with existing flue-type heat exchangers is the lack of conditioning of room air with moisture. When cool air is heated at constant specific humidity, the relative humidity is reduced and the effect is produced "dry" air. This circumstance is particularly is observed in extremely cold weather. Very dry air can cause discomfort to building occupants and is also unhealthful in causing chapping of lips, etc.

SUMMARY OF THE INVENTION

The present invention is a heat exchanger for a stove flue comprising a central smoke and flue-gas conducting tube; a tubular casing surrounding the inner tube, the casing provided with an inlet and outlet for circulation of room air throughout the casing; and a vaporizer for improving heat exchange without use of fins or baffles and also for conditioning room air. The vaporizer of the present invention is preferably in the form of a helical copper tube resting in the casing in contact with the inner flue-gas conducting tube. The coil, besides being noncorrosive, maximizes heat exchange between water contained within the coil and the inner tube per unit volume. The coil is provided on its uppermost surface with a plurality of vapor vents for discharging vapor into the casing. The invention provides improved heat exchange by utilizing water vapor, water having considerably higher specific heat, or more properly, thermal capacity than air. Additionally, the latent heat of vaporization of water is utilized as well as the super heating of steam exiting the vapor vents as it contacts the inner tube for maximizing heat exchange without the use of baffles, fins, or circuitous routing of either flue gases or room air. As is well known, when any condensation of a vapor to a liquid occurs, the heat of vaporization is given off in the process. In the instant case, this heat of vaporization provides room warmth. Also, when a vapor is super-heated, greater heat is given off in the cooling process as compared to a naturally occurring gas or gases such as air, because of the greater specific heat of the vapor. These processes result in considerable improvement in the heat exchange characteristics of the present invention. A more thorough description of the invention may be found in the appended claims.

It is therefore an object of the present invention to provide a heat exchanger for stove flues which utilizes the thermal heat capacity of water to improve heat exchange.

More specifically, it is an object of the present invention to provide a heat exchanger for stove flues which includes a helical copper coil as a vaporizer for increasing heat exchange between an inner flue tube and room air.

It is also an object of the present invention to provide a vaporizer to condition room air by the addition of moisture for a more healthy and comfortable environment. These and other objects and advantages will become apparent and a more thorough and comprehensive understanding may be had from the following description taken in conjunction with accompanying drawings forming a part of the specification.

BRIEF DESCRIPTION OF THE DRAWINGS

FIG. 2 is a sectional side elevation view along lines 2—2 of FIG. 1.

FIG. 3 is a plan view of the vaporizer showing vapor vents.

FIG. 4 is a plan view of the middle plate.

FIG. 5 is a perspective view of an alternate vaporizer.

DETAILED DESCRIPTION OF THE INVENTION

Figure 1:
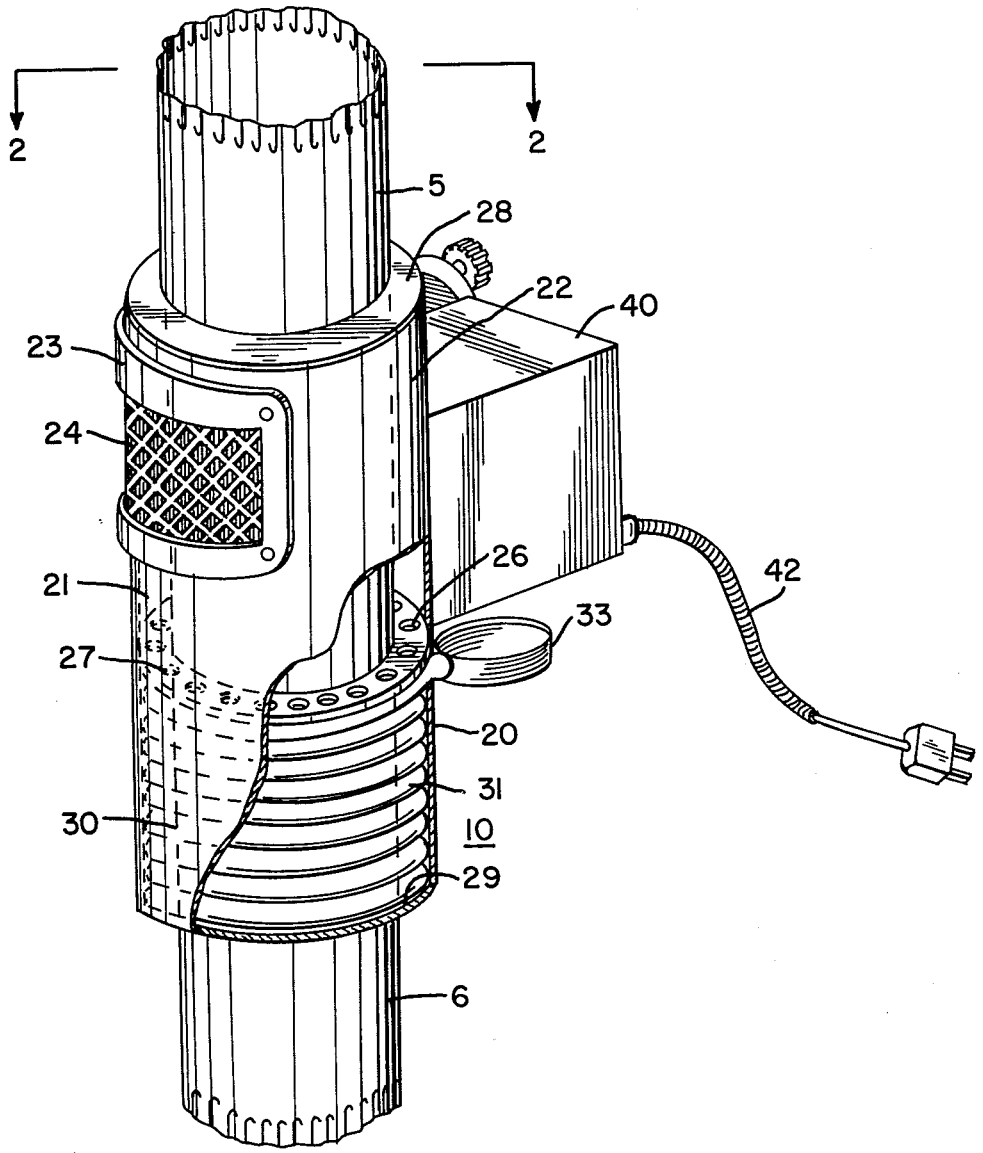
FIG. 1 is a perspective view of a preferred embodiment of the present invention shown in partial section.

Referring to the drawings, more particularly to FIGS. 1 and 2, an embodiment to be preferred of a heat exchanger and vaporizer 10, made according to the present invention is disclosed. Unit 10 includes an inner tube 5, a hollow tubular casing 20 enveloping the inner tube, a vaporizer 30, and means for producing air flow through the casing, motor-fan unit 40.

Tube 5 is an elongated flue tube in the nature of conventional flues and includes end portions 6 which are adapted to attach to existing stove pipes of free standing stoves. Tube 5 conveys hot products of combustion from a stove to a chimney through existing flues and serves as a heat exchange member in the present invention.

Enveloping tube 5 is a hollow sheet-metal casing 20 which is preferably tubular and concentric with inner tube 5. Casing 20 is provided with a pair of plates 28 and 29 which surround tube 5 adjacent the topmost end and the bottommost end, respectively of the casing. Where the apparatus is not provided with means for producing an air flow, such as motor-fan unit 40, plates 28 and 29 are provided with large apertures for convectional air flow. In the preferred embodiment, where a motor-fan unit is provided, plates 28 and 29 are closure plates sealingly engaging tube 5 so that air flow may be directed from inlet 22, through cavity 21 defined by tube 5 and casing 20, and through outlet 24 into the space to be heated. Lower plate 29 also functions as a support for vaporizer 30. An additional annular plate, middle plate 27, shown to advantage in FIG. 4 is recommended. Middle plate 27, in affording support, is affixed between casing 20 and inner tube 5 above vaporizer 30. Plate 27 is provided with a plurality of apertures 26 for passage of vapors from the vaporizer 30 into cavity 21 and through outlet 24. Outlet 24 may be provided with a protective screen 23 to prevent contact with the inner tube 5. In registry with inlet 22 of casing 20 is an electric motor-fan unit 40 which may be thermostatically controlled. The motor-fan unit may be of any desired capacity and is conventional in the art.

Vaporizer 30 is preferably in the form of a helical coil 31 which is closed at its lowermost end and which terminates at its uppermost end into a pour spout 33. Pour spout 33 is located externally of casing 20 and is connected to coil 31 by means of an opening in the casing. It is desirable that the upper rim of the pour spout be at or below the vapor vents 35 of coil 31 to prevent over filling of the coil with water. Coil 31 is constructed of a metal having high heat conductivity and which is noncorrosive when used with water. Copper, in meeting these requirements, and in being highly malleable is an ideal metal for construction of the vaporizer. The diameter of the coil used may vary but is preferably of a size the same or slightly smaller than cavity 21 of casing 20 into which it fits. For example, an exchanger 10 utilizing a flue tube 5 which is six inches in diameter and a concentric casing which has an inside diameter of seven and one-half inches plus, will have a coil 31 which is three quarters inches in diameter. It will then be seen that helical coil 31 envelops a portion of inner tube 5; is in heat exchange contact with tube 5; and permits use of a casing 20 which is only slightly larger in diameter than the inner tube 5 as it rests upon support flange 29. It will also be seen that coil 31 provides a maximum heat conductive surface for the volume which it occupies. Helical coil 31, upon its uppermost surface, that is on the topmost portion of the uppermost coil, includes a plurality of vapor vents 35 as shown in FIG. 3. The vapor vents, being numerous, yet small in diameter, provide a large surface area for vapor discharge while, in combination with the upper wall of the uppermost coil, preventing overflow due to the boiling of the water. This, in turn, prevents excessive corrosion of the casing 20 and inner tube 5.

In FIG. 5, an alternate embodiment of a vaporizer 30[1] is shown. Vaporizer 30[1] is constructed preferably of copper or aluminum and includes a container having a pair of concentric wall structures 38 and 39 and a bottom wall 36 defining a container 37 therebetween for holding water. A pour spout 33[1] externally located relative to casing 20 is also provided. Vaporizer 30[1], while suitable, does not provide the large surface area of the helical coil 31 of vaporizer 30 for heat exchange from inner tube 5 and hot air surrounding the coil, per unit volume and is not as satisfactory as coil 31 in preventing overflow due to boiling.

For operation an existing flue pipe is removed from the stove to chimney venting system and apparatus 10 of the present invention is installed in its stead with flue engaging portions 6 of inner flue-gas conducting tube 5 mating with existing flue members for holding unit 10 in place. Motor-fan unit 40 is then connected by wiring 42 to an electric outlet, vaporizer 30 or 30[1] is filled with water via pour spout 33 or 33[1], respectively, and the unit is ready for service.

Assuming vaporizer 30 is utilized in unit 10, the following activity takes place (upon burning material in the stove, not shown.) As hot flue gases are conveyed through inner tube 5, the tube is heated, thereby heating the air in cavity 21 and also heating coil 31 of vaporizer 30 by conduction both from direct contact between coil 31 and inner tube 5 and by air heated in its contact with the inner tube. Water contained within coil 31 is vaporized and the steam thus produced exits through vapor vents 35 into cavity 21 where the air, heavily laden with moisture, contacts the hot wall of inner tube 5 for heat exchange therewith. There the air-vapor mixture having a much greater thermal capacity than the otherwise "dry" air, conducts a significantly greater amount of heat from inner tube 5 than would otherwise be conducted. Additionally the air-vapor mixture may become superheated in its contact with inner tube 5 to carry even greater amounts of heat into the room to be heated. Motorfan unit 40, preferably thermostatically controlled produces an airflow from inlet 22, about inner tube 5, through cavity 21 and out the outlet 24 into the room to provide improved space heating and conditioning from the auxiliary heat source, exchanger 10.

Having thus described in detail a preferred selection of embodiment of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A heat exchanger for a stove flue comprising:

an elongated flue-gas conducting inner tube provided on opposing ends with means for connection with an existing flue;

a hollow tubular casing attached to and enveloping said inner tube, said casing including an inlet and an outlet for airflow therethrough; and liquid vaporization means contained within said casing, said vaporization means including a liquid container in heat exchange contact with said inner tube, said liquid container having a helically coiled pipe sealed at its lowermost end and terminating at its uppermost end into a pour spout located exteriorally of said casing, said coiled pipe provided upon its uppermost surface with a plurality of vapor vents for conducting vapor from said helical pipe through the hollow of said casing and through said outlet for auxiliary space heating and conditioning.

2. The apparatus as described in claim 1, further comprising means for producing an airflow through said casing for space heating and conditioning.

3. A heat exchanger for a stove flue comprising:

an elongated inner flue-gas conducting tube having means on opposing ends for connection to an existing flue;

a hollow tubular casing attached to and enveloping said inner tube, said casing including vertically spaced upper and lower plates engaging said inner tube to define an enclosed cavity between the casing and the inner tube, said casing also including an air inlet and an air outlet;

vaporization means located within said enclosed cavity, said vaporization means including a helically coiled pipe in heat exchange relationship with said inner tube, said pipe sealed at one end and opening at its other end externally of said casing for liquid filling thereof, said coiled pipe provided on its uppermost surface with a plurality of vapor vents for the discharging of water vapor into said enclosed cavity; and means for producing an air flow for forcing air into said enclosed cavity through said inlet and circulating said air and moisture from said vaporization means in heat exchange with said inner tube and through said outlet of said casing for space heating and conditioning.

4. The apparatus as described in claim 3 wherein said helically coiled pipe is made of copper.

5. The apparatus as described in claim 3 wherein said means for producing an airflow is connected to said casing adjacent said inlet for forcing air therethrough.

* * * * *